US009410320B2

(12) United States Patent
Murata et al.

(10) Patent No.: US 9,410,320 B2
(45) Date of Patent: Aug. 9, 2016

(54) REINFORCED CONCRETE STRUCTURE

(71) Applicant: NETUREN CO., LTD., Shinagawa-ku, Tokyo (JP)

(72) Inventors: Yoshiyuki Murata, Tokyo (JP); Satoru Kakoo, Tokyo (JP); Toshio Ito, Tokyo (JP); Makoto Takaoka, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 0 days.

(21) Appl. No.: 14/723,904

(22) Filed: May 28, 2015

(65) Prior Publication Data

US 2015/0345128 A1 Dec. 3, 2015

(30) Foreign Application Priority Data

May 30, 2014 (JP) ..... 2014-112292

(51) Int. Cl.

| | |
|---|---|
| ***E04C 5/01*** | (2006.01) |
| ***E04B 1/21*** | (2006.01) |
| ***E04C 3/34*** | (2006.01) |
| ***E04C 5/06*** | (2006.01) |

(52) U.S. Cl.

CPC ..... *E04C 3/34* (2013.01); *E04C 5/0604* (2013.01); *E04C 5/0645* (2013.01); *E04B 2103/02* (2013.01)

(58) Field of Classification Search

CPC ..... E04C 3/20; E04C 5/06; E04C 5/0604; E04B 1/165; E04B 1/043; E04B 5/43

See application file for complete search history.

(56) References Cited

U.S. PATENT DOCUMENTS

| | | | | |
|---|---|---|---|---|
| 1,461,891 | A * | 7/1923 | Coney | E04B 5/43 52/253 |
| 4,769,886 | A * | 9/1988 | Berchem | C22C 38/44 148/534 |
| 7,637,136 | B2 * | 12/2009 | Horita | B21C 23/001 148/643 |
| 2001/0046417 | A1 * | 11/2001 | Iemura | E02B 3/06 405/256 |
| 2013/0305652 | A1 * | 11/2013 | Iihoshi | E04C 5/00 52/664 |

FOREIGN PATENT DOCUMENTS

| | | |
|---|---|---|
| JP | 3147699 | 12/2008 |

* cited by examiner

*Primary Examiner* — Christine T Cajilig
(74) *Attorney, Agent, or Firm* — Wenderoth, Lind & Ponack, L.L.P.

(57) ABSTRACT

A main reinforcing bar has a strength transition portion between a normal strength portion and a high strength portion. The high strength portion is arranged in a joint section. The boundary between the normal strength portion and the strength transition portion is configured as a deigned point. The designed point is designed such that, at the time of an earthquake, the main reinforcing bar yields at the designed point before the main reinforcing bar yields at the root of the beam at of the joint section. The boundary between the high strength portion and the strength transition portion is located in the joint section, and the root of the beam is located at the strength transition portion. The strength of the strength transition portion at the root of the beam is equal to or higher than the required strength.

4 Claims, 4 Drawing Sheets

REINFORCED CONCRETE STRUCTURE

CROSS-REFERENCE TO RELATED APPLICATION

The present application claims priority from Japanese Patent Application No. 2014-112292 filed on May 30, 2014, the entire content of which is incorporated herein by reference.

FIELD OF INVENTION

The present invention relates to a reinforced concrete structure.

BACKGROUND

In related art reinforced concrete structures such as columns and beams, reinforcing bars have different strengths at column-beam joint sections and intermediate sections. For example, a related art reinforced concrete structure has reinforcing bars, each having a normal strength portion and a high strength portion having higher strength than the normal strength portion, and the high strength portion is arranged in a section where the stress caused by an earthquake is larger than the stress caused by the application of a long term load (see, e.g., JP3147699U).

According to a related art disclosed in JP3147699U, the high strength portion and the normal strength portion are formed so as to be adjacent to each other in each main reinforcing bar. To form the high strength portion, a corresponding portion of a normal reinforcing bar is heat-treated. Usually, a main reinforcing bar is heat treated while feeding the main reinforcing bar relative to a heating apparatus. To form the main reinforcing bar of JP3147699U, the normal reinforcing bar is fed into the heating apparatus by a given length and then the portion corresponding to the high strength portion is heated.

When the heating is performed while feeding the normal reinforcing bar, a strength transition portion is produced between the normal strength portion and the high strength portion where the strength shifts from the normal strength portion to the high strength portion in a continuous manner. However, JP3147699U does not teach to consider such strength transition portions in a strength design.

SUMMARY

It is an object of the present invention to provide a reinforced concrete structure that can be constructed easily using main reinforcing bars having a strength transition portion between a normal strength portion and a high strength portion.

The reinforced concrete structure according to the present invention includes a plurality of first longitudinal reinforcing bars forming a first frame member; and a plurality of second longitudinal reinforcing bars forming a second frame member, the second longitudinal reinforcing bars intersecting the first longitudinal reinforcing bars in a joint section in which the first frame member and the second frame member are joined to each other, wherein each of the first longitudinal reinforcing bars comprises a first bar portion having a yield point or a 0.2% proof stress defined by JIS G3112, a second bar portion having a strength higher than a strength of the first bar portion, and a strength transition portion provided between the first bar portion and the second bar portion and having a strength higher than the strength of the first bar portion but lower than the strength of the second bar portion, the first bar portion, the second bar portion and the strength transition portion are formed as a single bar structure, wherein the second bar portion is arranged in the joint section, wherein a boundary between the first bar portion and the strength transition portion is configured as a design point, the designed point being designed such that, when an external force is applied, the first longitudinal reinforcing bar yields at the designed point before the first longitudinal reinforcing bar yields at a root of the first frame member at the joint section, wherein a boundary between the second bar portion and the strength transition portion is located inside the joint section, and the root of the first frame member is located at the strength transition portion, and wherein the strength of the strength transition portion at the root of the first frame member is designed to be equal to or higher than a strength back-calculated from a moment distribution.

Sufficient strength is required at the root of the first frame member at the joint section so that the main reinforcing bar (the first longitudinal reinforcing bar) does not yield at the root of the first frame member before it yields at the designed point. Here, when the root of the first frame member is at the middle of the strength transition portion, there is no problem if the strength against the bending moment at the root is sufficient. On the other hand, when producing the main reinforcing bar having the normal strength portion and the high strength portion, a certain length of strength transition portion is necessary. Hence, according to the present invention, by setting the gradient of the strength larger than the gradient of the moment, it is applicable even when the main reinforcing bar has long strength transition portion. In other words, it is made applicable to a building by designing the strength of the strength transition portion at the root of the first frame member at the joint section to be equal to or higher than the required strength back-calculated from a moment distribution. Furthermore, the longer the strength transition portion, more efficiently the main reinforcing bar can be heat-treated to have regions with different strengths. In other words, by making the strength transition portion longer, the relative movement speed of the main reinforcing bar with respect to the heating apparatus can be increased when shifting the region to be heated from the normal strength portion to the high strength portion, whereby the production efficiency of the main reinforcing bars can be improved.

The reinforced concrete structure according to the present invention includes a plurality of first longitudinal reinforcing bars forming a first frame member; and a plurality of second longitudinal reinforcing bars intersecting the first longitudinal reinforcing bars and forming a plurality of second frame members, wherein each of the first longitudinal reinforcing bars comprises a first bar portion having a yield point or a 0.2% proof stress defined by JIS G3112, a second bar portion having a strength higher than a strength of the first bar portion, and a strength transition portion provided between the first bar portion and the second bar portion and having a strength higher than the strength of the first bar portion but lower than the strength of the second bar portion, the first bar portion, the second bar portion and the strength transition portion are formed as a single bar structure, wherein the second bar portion is arranged in a joint section in which the first frame member and one of the second frame members are joined to each other, wherein a boundary between the first bar portion and the strength transition portion is configured as a design point, the designed point being designed such that, when an external force is applied, the first longitudinal reinforcing bar yields at the designed point before the first longitudinal reinforcing bar yields at a root of the first frame member at the joint section, wherein a boundary between the second bar portion and the strength transition portion is located at or away from the root of the first frame member, wherein a distance between opposed surfaces of adjacent ones of the second frame member is 2 meters or longer but not longer than 8 meters, and a length of the strength transition portion is equal to or shorter than 1.5 meters.

As described above, sufficient strength is required at the root of the first frame member at the joint section so that the main reinforcing bar does not yield at the root of the of the first frame member before it yields at the designed point. Here, for the effective use of the high strength portion, the strength thereof may merely be designed so as to be equal to or higher than the strength required at the root of the first frame member, and a reinforcing bar having no strength transition portion is not always necessary. In other words, when using a main reinforcing bar having the strength transition portion disposed between the high strength portion and the normal strength portion, the boundary between the strength transition portion and the high strength portion may be located at or away from the root of first frame member at the joint section. In this case, the relationship between the strength transition portion of the main reinforcing bar and the distance between the opposed surfaces of the adjacent second frame members has to be reasonably set. Hence, according to the present invention, it is found that, if the dimension between the adjacent second frame members is 2 meters or longer but not longer than 8 meters, and if the length of the strength transition portion is equal to or shorter than 1.5 meters, application is possible in consideration of possible application portions (frames, such as columns, beams, walls and floors) and the gradient of moment distribution. In the meantime, in the production of the main reinforcing bars described above, the relative feeding speed of the main reinforcement to be fed to the heating apparatus during heating can be increased by making the strength transition portion longer, so that the main reinforcing bars can be produced easily.

In the present invention, it is preferable that the frame member is a beam and the other frame member is a column. In this configuration, in the case that the beam main reinforcing bar having the strength transition portion between the normal strength portion and the high strength portion is used, buildings can have aseismatic structures.

DETAILED DESCRIPTION

A first embodiment according to the present invention will be described with reference to FIGS. 1 to 5. In the first embodiment, an example of a building having an aseismatic structure is shown, and an earthquake is an example of an external force to be applied.

Figure 1:
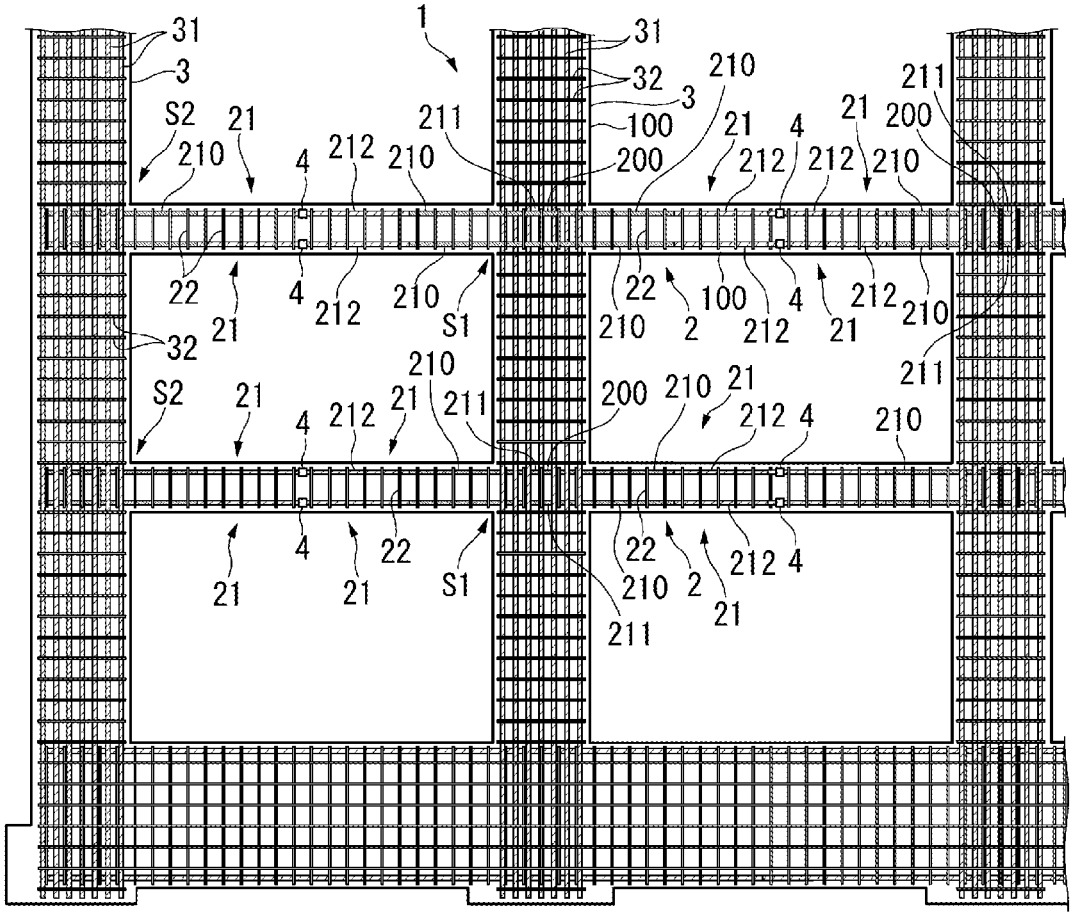
FIG. 1 is a schematic view of a reinforced concrete structure according to an embodiment of the present invention.
Figure 2:
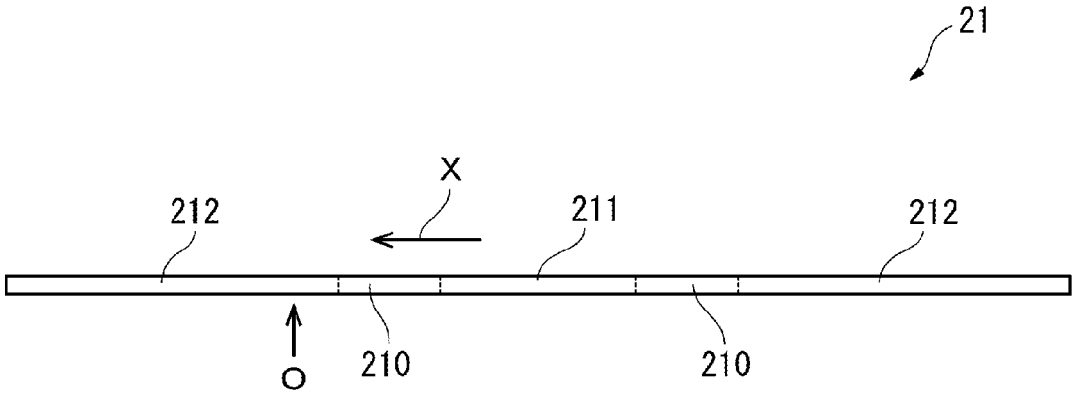
FIG. 2 is a front view of a reinforcing bar according to an embodiment of the present invention.

FIG. 1 shows an overall configuration of this embodiment, and FIG. 2 shows a main reinforcement. In FIG. 1, the building is a reinforced concrete structure having a plurality of stories, including a plurality of beams 2 (first frame members) and a plurality of columns 3 (second frame members) and joined to the beams 2, and a concrete body 100 is placed in a rebar structure 1. The beams 2 and the columns 3 are joined to each other at joint sections such as cross-shaped joints 51 and T-shaped joint S2, but the present embodiment is applicable to other types of joints. In the following description, the cross-shaped joints 51 will be described in detail as an example.

The rebar structure 1 of the beam 2 includes a plurality of beam main reinforcing bars 21 (first longitudinal reinforcing bars) arranged so as to extend in the horizontal direction and a plurality of beam shear reinforcing bars 22 arranged at equal intervals so as to surround the main reinforcing bars 21 in a plane intersecting the axial direction of the main reinforcing bars 21 and to reinforce the shearing strength of the beam 2. The main reinforcing bars 21 adjacent to each other in the horizontal direction are joined with a joint 4. The joint 4 may be a mechanical joint or another joint. Alternatively, a configuration may also be used in which the end sections thereof are overlaid and connected to each other using wires or the like. The rebar structure 1 of the column 3 includes a plurality of column reinforcing bars 31 (second longitudinal reinforcing bars) arranged at predetermined intervals so as to extend in the vertical direction and a plurality of column shear reinforcing bars 32 arranged in the extension direction of the reinforcing bars 31 at equal intervals so as to surround the reinforcing bars 31 in a plane intersecting the axial direction of the reinforcing bars 31 and to reinforce the shearing strength of the column 3. The reinforcing bars 31 and the shear reinforcing bars 32 are normal reinforcing bars. Since FIG. 1 is a view showing the outline of this embodiment, the numbers and arrangements of the main reinforcing bars 21 and the reinforcing bars 31 are different from those shown in FIG. 3 described later.

As shown in FIG. 2, the main reinforcing bar 21 has a high strength portion 211 (second bar portion) at the central portion thereof and has a normal strength portion 212 (first bar portion) at each of both the end sections thereof. A strength transition portion 210 is provided between the high strength portion 211 and the normal strength portion 212. The high strength portion 211, the normal strength portions 210 and the strength transition portions 210 are integrally formed from a single reinforcing bar.

The yield point or 0.2% proof stress of the normal strength portion 212 is defined in JIS G3112. The yield point or 0.2% proof stress defined in JIS G3112 is in a range of 235 MPa to 625 MPa. The strength of the high strength portion 211 is higher than that of the normal strength portion 212. The strength of the strength transition portion 210 is higher than that of the normal strength portion 212 and is lower than that of the high strength portion 211. For example, the yield point or 0.2% proof stress of the high strength portion 211 is 490

MPa (N/mm$^2$) or more and 1000 MPa (N/mm$^2$) or less. The yield point or 0.2% proof stress of the normal strength portion 212 is 295 MPa (N/mm$^2$) or more and 390 MPa (N/mm$^2$) or less. In this embodiment, as shown in FIG. 3, the strength of the high strength portion 211 is set by making the strength gradient thereof greater than the seismic moment gradient of the strength transition portion 210.

Figure 3:
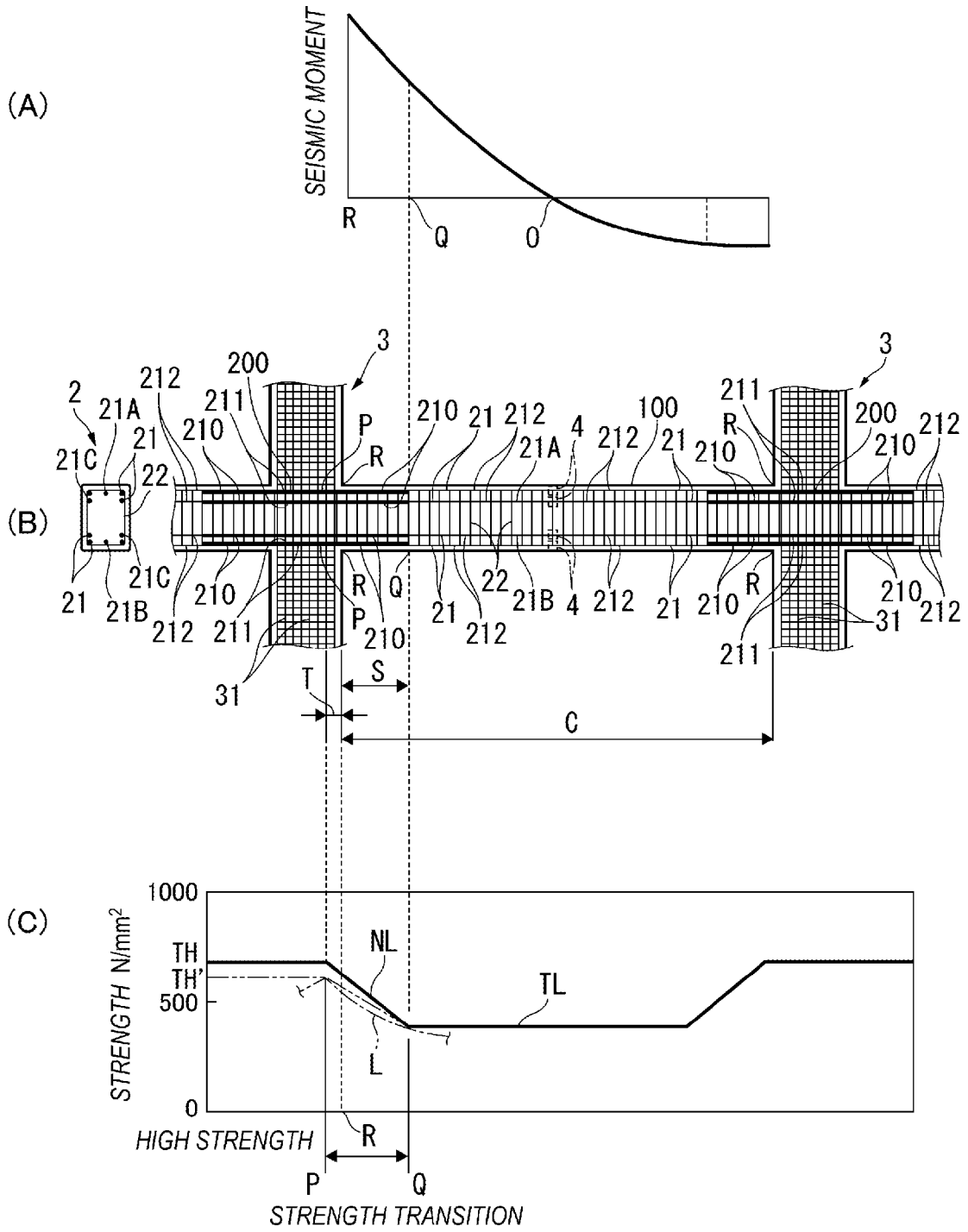
FIG. 3 illustrates a main reinforcement according to a first embodiment of the present invention, including (A) a seismic moment distribution diagram indicating a relationship between a location on the main reinforcement and the seismic moment, (B) a schematic front view and a schematic side view of the main reinforcement, and (C) a strength distribution chart indicating a distribution of the strength of the main reinforcement.

FIG. 3. illustrates (A) a seismic moment distribution, (B) a schematic front view and a schematic side view of the main reinforcement, and (C) a strength distribution. As shown in (B) of FIG. 3, the main reinforcing bar 21 is formed of three upper sections 21A and three lower sections 21B, respectively arranged in parallel in the horizontal direction at the upper and lower positions, and two side sections 21C arranged in the horizontal direction on both sides at a height between the upper sections 21A and the lower sections 21B. Although the number of the sections of the main reinforcing bar 21 is not limited to 10, the number is preferably 5 or more and 10 or less. A plurality of shear reinforcing bars 22 are disposed so as to cover the outer circumferential portions of the upper sections 21A, the lower sections 21B and the side sections 21C at positions away from the joint section 200 of the main reinforcing bar 21. These shear reinforcing bars 22 are disposed at equal intervals in the longitudinal direction of the beam. The distance C between the opposed vertical surfaces of the adjacent columns 3, that is, the length between the roots R of the beam 2 at the adjacent joint sections 200, is 2 meters or longer but not longer than 8 meters.

The shear reinforcing bar 22 is preferably made of ULBON 1275 (a trade name of Neturen Co., Ltd.) having a yield point or 0.2% proof stress (1275 MPa (N/mm$^2$)) larger than the yield point or 0.2% proof stress (345 MPa (N/mm$^2$)) of an normal reinforcing bar. In this embodiment, however, a shear reinforcing bar having the same yield point or 0.2% proof stress as that of the normal reinforcing bar may also be used instead of ULBON 1275.

In the seismic moment distribution shown in (A) of FIG. 3, the moment is 0 at the joint of the normal strength portions 212 of the adjacent main reinforcing bars 21 and becomes larger toward the root R of the beam 2 at the joint section 200 on the left in (B) of FIG. 3. The seismic moment is obtained by adding the moment due to only an earthquake load to a constant (self-weight) moment. The designed point Q in this embodiment is a location designed such that, at the time of an earthquake, the main reinforcing bar 21 yields at this location position before it yields at the root R of the beam 2. Sufficient strength is required at the root R such that, in response to the seismic moment, the reinforcing bar does not yield at the root R of the joint section 200 before the reinforcing bar yields at the designed point Q, when calculated with the strength of the normal reinforcing bar. Here, to effectively use the high strength portion 211, it is preferable that the high strength portion 211 exists at the root R. However, the root R may be located in the middle of the strength transition portion 210, and even in this case, it is problem if there is sufficient strength against the seismic moment (e.g., about 1000 kN·m to 2000 kN·m) at the root R of the beam 2.

In the first embodiment, the boundary P between the high strength portion 211 and the strength transition portion 210 is located inside the joint section 200, that is, located inwardly away from the root R of the beam 2 at the joint section 200 by a distance T, so that the root R is located in the middle of the strength transition portion 210. The boundary between the strength transition portion 210 and the normal strength portion 212 is the designed point Q, and the designed point Q is located at a position away from the root R, that is, away from the outer surface of the joint section 200, by a distance S. The number of the reinforcing bars (10 in this embodiment) is calculated such that the required normal strength is obtained at the designed point Q.

The strength of the strength transition portion 210 at the root R is set so that the strength is equal to or more than the strength of the high strength region that is obtained according to the seismic moment distribution. In (C) of FIG. 3, the distribution of the strength of the main reinforcing bar 21 is indicated by a solid line, and the distribution of the strength required for the main reinforcing bar back-calculated from the seismic moment distribution of (A) of FIG. 3 based on a known mathematical formula or the like is indicated by a chain line. However, in (C) of FIG. 3, the distribution of the required strength is illustrated with a portion thereof being omitted. As shown in (C) of FIG. 3, the strength of the main reinforcing bar 21 is represented by the strength TH at the high strength portion 211, the strength TL at the normal strength portion 212 and the strength NL at the strength transition portion 210. The strength NL is represented by the line segment connecting the end sections of the strength TL and the strength TH. The strength TH is also required at the root R. The required strength at the root R and the required strength at the designed point Q are connected by a curve L, and the value of the strength at the position of the boundary P between the strength transition portion 210 and the high strength portion 211 represents the required strength TH' that is required at the high strength portion 211 in this embodiment. In other words, the gradient indicated by the curve L represents the required strength required at the time of an earthquake. The strength of the main reinforcing bar 21 is set so that the gradient of the strength NL between the designed point Q and the boundary P is larger than the gradient (indicated by a two-dot chain line) obtained from the curve L.

The main reinforcing bar 21 for use in this embodiment is heated while a normal reinforcing bar and a heating apparatus (not shown) are moved relatively in the longitudinal direction of the normal reinforcing bar. For example, as shown in FIG. 2, a single normal reinforcing bar (for example, the diameter of the reinforcing bar is D3 and the material thereof is SD3) is moved in the longitudinal direction of the reinforcing bar indicated by an arrow X and is heated by a heating apparatus (not shown) disposed at the left end in FIG. 2. The position in which the heating starts is the position indicated by "0" and hardening is performed at about 1000° C. at the position "0". Since the temperature inside the reinforcing bar does not rise abruptly at the position "0", the strength does not become large immediately; the strength becomes large when the normal reinforcing bar is moved to a predetermined position, that is, at the time when the reinforcing bar is moved to the right side away from the position "0" by a predetermined dimension. After the hardening, tempering is performed at 410° C.

Figure 4:
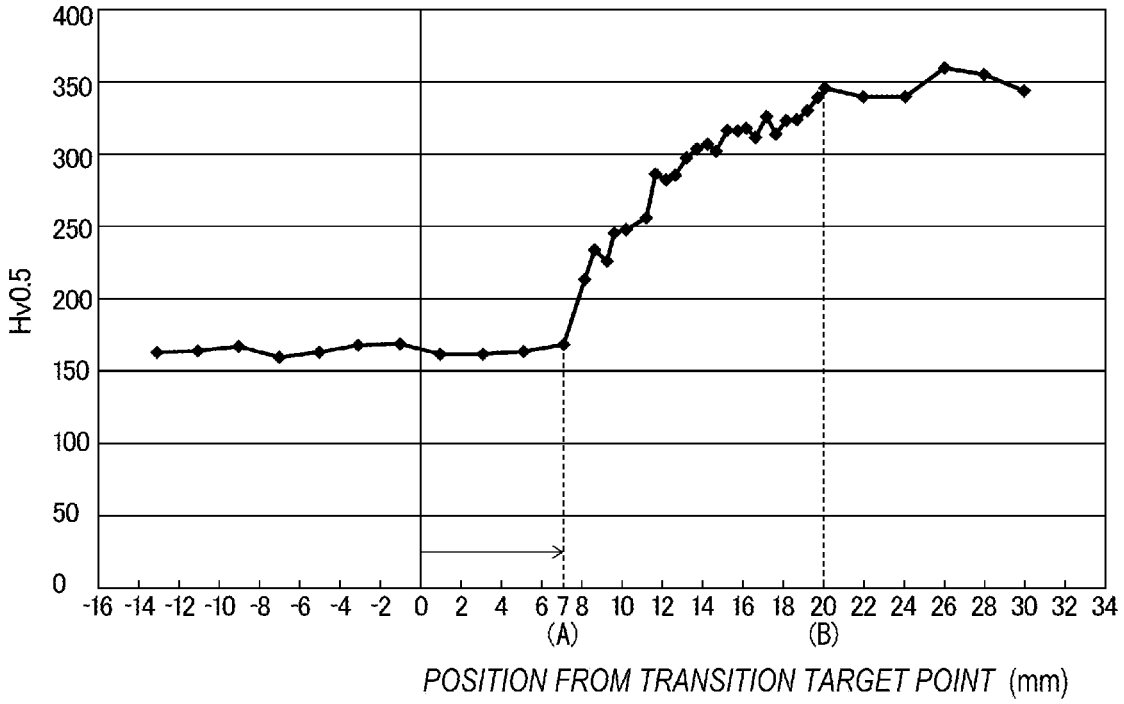
FIG. 4 is a graph indicating a relationship between a location on a reinforcing bar and the Vickers hardness thereof.

A Vickers hardness test and a tensile test were performed for the main reinforcing bar 21 produced by the above-mentioned method. The result of the Vickers hardness test is shown in FIG. 4. In FIG. 4, the horizontal axis represents the position along the longitudinal direction of the normal reinforcing bar. The position 0 on the horizontal axis is the start position of the hardening; the right side from the position 0 is a heat treatment side and is represented by a positive numerical value, and the left side from the position 0 is a non-heat treatment side and is represented by a negative numerical value. The Vickers hardness of the normal reinforcing bar having been moved to a position A (7 mm) from the hardening start position 0 is not changed significantly from that of the normal reinforcing bar; however, when the normal reinforcing bar advances to a position B (20 mm) from the position A, the Vickers hardness thereof increases gradually, and at the position B and beyond the position, the Vickers hardness reaches the hardness that is obtained finally. The region between the position A and the position B corresponds to the strength transition portion 210. The region on the non-heat treatment side and the region from the position 0 to the position A correspond to the normal strength portion 212. The right region from the position B corresponds to the high strength portion 211.

When a tensile test was performed for the main reinforcing bar 21 produced as described above, the measured value of the yield point or 0.2% proof stress of the normal strength portion 212 was 388 MPa (N/mm$^2$), the measured value of the tensile strength thereof was 550 N/mm$^2$, and the measured value of the elongation (JIS No. 2, 8d) thereof was 28%. The influence of the heat treatment on the normal strength portion 212 was not found. Here, "JIS No. 2, 8d" means that the elongation was measured using a test piece No. 2 as defined in JIS Z 2201 with a gauge length of 8d (d: diameter of the test piece). The yield point or 0.2% proof stress of the normal reinforcing bar forming the normal strength portion 212 is 345 MPa (N/mm$^2$) or more and 440 MPa (N/mm$^2$) or less, the tensile strength thereof is 490 N/mm$^2$) or more, and the elongation (JIS No. 2, 8d) thereof is 18% or more according to JIS G3112 SD345. According to the steel material certificate for the normal reinforcing bar before processing, the yield point or 0.2% proof stress thereof is 386 MPa (N/mm$^2$), the tensile strength thereof is 536 N/mm$^2$), and the elongation (JIS No. 2, 8d) thereof is 25%.

The measured value of the yield point or 0.2% proof stress of the strength transition portion 210 was 393 MPa (N/mm$^2$), the measured value of the tensile strength thereof was 556 N/mm$^2$, and the measured value of the elongation (JIS No. 2, 8d) thereof was 28%. Embrittlement and deterioration in strength were not found in the strength transition portion 210. The measured value of the yield point or 0.2% proof stress of the high strength portion 211 was 1014 MPa (N/mm$^2$), the measured value of the tensile strength thereof was 1106 N/mm$^2$, and the measured value of the elongation (JIS No. 2, 8d) thereof was 10%. As described above, it is found that the main reinforcing bar 21 in which the normal strength portions 212, the high strength portion 211 and the strength transition portions 210 are formed integrally is produced from a single normal reinforcing bar by the heat treatment.

According to the first embodiment described above, the main reinforcing bar 21 is configured in which the normal strength portions 212, the high strength portion 211, and the strength transition portions 210 disposed between the normal strength portion 212 and the high strength portion 211 and having a strength higher than that of the normal strength portion 212 and lower than that of the high strength portion 211 are formed as a single bar structure. Furthermore, the high strength portion 211 is arranged in the joint section 200, the boundary between the normal strength portion 212 and the strength transition portion 210 is configured as the designed point Q designed such that, at the time of an earthquake, a yield occurs at the designed point Q before a yield occurs at the root R of the main reinforcing bar 21 at the joint section 200, the boundary between the high strength portion 211 and the strength transition portion 210 is located inside the joint section 200, the root R of the beam at the joint section 200 is located at the strength transition portion 210, and the strength of the strength transition portion 210 at the root R of the beam is designed to be TH that is equal to or higher than the required strength TH' back-calculated from the seismic moment distribution. That is, by making the gradient of strength greater than the gradient of the seismic moment, it can be used for buildings having aseismatic structures, even when the strength transition portions 210 are long. Moreover, by making the strength transition portions 210 of the main reinforcing bar 21 long, the feeding speed of the normal reinforcing bar can be increased when producing the main reinforcing bar 21 from a single normal reinforcing bar, whereby the main reinforcing bars 21 can be produced efficiently.

The beam 2 is configured to have the structure described above. Therefore, buildings having aseismatic structures can be constructed using the beam main reinforcing bars 21 each having the strength transition portion 210 between the normal strength portion 212 and the high strength portion 211.

Next, a second embodiment of the present invention will be described with reference to FIG. 5. The second embodiment is different from the first embodiment in the arrangement of the main reinforcing bar 21 with respect to the joint section 200, but is the same as the first embodiment with regard to the other configurations. As in the first embodiment, the main reinforcing bar 21 according to the second embodiment has the high strength portion 211 at its central portion, has the strength transition portion 210 on each of both the sides of the high strength portion 211, and has the normal strength portion 212 on each of both the end sides. The high strength portion 211, the normal strength portions 212 and the strength transition portions 210 are formed integrally from a single reinforcing bar. The yield points or 0.2% proof stress of the high strength portion 211, the normal strength portion 212 and the strength transition portion 210 are the same as those according to the first embodiment.

Figure 5:
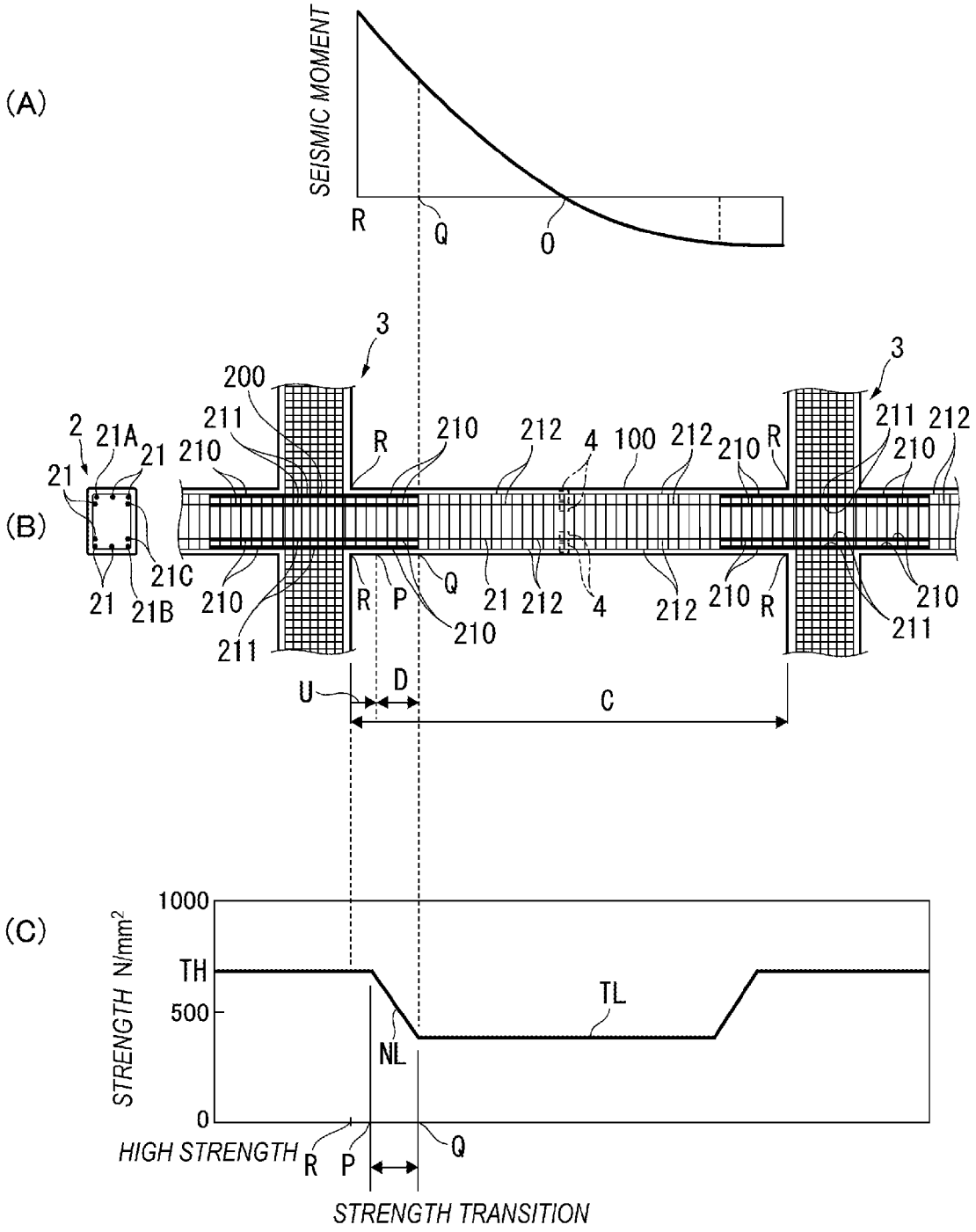
FIG. 5 illustrates a main reinforcement according to a second embodiment of the present invention, including (A) a seismic moment distribution diagram indicating a relationship between a location on the main reinforcement and the seismic moment, (B) a schematic front view and a schematic side view of the main reinforcement, and (C) a strength distribution chart indicating a distribution of the strength of the main reinforcement.

FIG. 5 illustrates (A) a seismic moment distribution diagram, (B) a schematic front view and a schematic side view of the main reinforcement, and (C) a strength distribution. As shown in (B) of FIG. 5, as in the first embodiment, the main reinforcing bar 21 is composed of the high strength portion 211, the normal strength portions 212, and the strength transition portions 210, each of the strength transition portions 210 being disposed between the high strength portion 211 and the normal strength portion 212. The normal strength portions 212 of the main reinforcing bars 21 adjacent to each other in the longitudinal direction are joined via the joints 4. The plurality of columns 3 is provided perpendicular to the main reinforcing bar 21, such that the distance C between the opposed surfaces of the adjacent columns 3 that are next each other is 2 meters or longer but not longer than 8 meters.

The seismic moment distribution shown in (A) of FIG. 5 is the same as the seismic moment distribution shown in (A) of FIG. 3. In the second embodiment, as in the first embodiment, calculation with respect to the seismic moment at the designed point Q is performed with the strength of the normal reinforcing bar. And sufficient strength is required at the root R of the beam such that the main reinforcing bar 21 does not yield at the root R before it yields at the designed point Q. Here, because it is preferable that the high strength portion 211 exists at the root R of the beam to effectively use the high strength portion 211, the boundary P between the high strength portion 211 and the strength transition portion 210 is located away outwardly from the root R of the beam by a distance U. In the second embodiment, the boundary P may located at the root R (U=0).

In this embodiment, the number of reinforcing bars (10 in this embodiment) is calculated so that the required strength is obtained at the designed point Q in terms of the strength of the normal reinforcing bar. In addition, an allowance is given to the strength of the high strength portion 211 so that the strength is higher than that at the designed point Q. As shown in (C) of FIG. 5, in the case that the strength of the high strength portion 211 is set in consideration of the gradient of the seismic moment distribution, if the distance C between the opposed vertical surfaces of the adjacent columns 3 (the length of the beam 2 between the roots R) is 2 meters or longer but not longer than 8 meters, the length D of the strength transition portion 210 is equal to or shorter than 1.5 meters, preferably 0.5 meters or longer but not longer than 1.0 meter. If it exceeds 1.5 meters, the length of the portion to be heat-treated using the normal reinforcing bar becomes too long, and the production cost of the main reinforcing bar 21 becomes high.

According to the second embodiment, the following effect can be provided in addition to the effect provided by the first embodiment. That is, in consideration of the beam and the gradient of the seismic moment distribution, with the distance C between the adjacent columns is 2 meters or longer but not longer than 8 meters, the length D of the strength transition portion 210 is designed to be equal to or shorter than 1.5 meters. Hence, even when the length D of the strength transition portion 210 is made long, buildings free from problems in strength calculation can be constructed. In addition, as in the first embodiment, in the production of the main reinforcing bar 21, the main reinforcing bar 21 can be produced easily by making the strength transition portions 210 longer.

The present invention is not limited to the embodiments described above, and the present invention includes modifications, improvements, etc. within the scope capable of achieving the object of the present invention. For example, although an earthquake is described as an example of an external force to be applied in the embodiments described above, the external force is not limited to the earthquake, and the present invention is applicable in a case in which a load having a bending moment distribution similar to that of an earthquake is applied to a building. That is, other than the seismic load described in the above embodiments, a fixed load (self-weight), a movable load, a snow load, a wind load, etc. are loads that cause a bending moment, the present invention is applicable in a case where such loads are applied to the building so that the moment distribution is similar to the seismic moment distribution shown in (A) of FIGS. 3 and 5. Further, although the main reinforcing bar 21 is used for a beam in the embodiments described above, the main reinforcing bar according to the present invention is not limited to be used for a beam, but can be used for a column 3, for example, and can further be applied to all the members constituting buildings, such as walls, floors and piles. In the case that the main reinforcing bar 21 is used instead of the reinforcing bar 31 so as to be used for a column, the reinforcing bar of the beam 2 may be formed of an normal reinforcing bar or may be formed of the main reinforcing bar 21 having the high strength portion 211, the strength transition portions 210 and the normal strength portions 212 as in each of the above-mentioned embodiments.

Moreover, although the joints 4 are used to join the normal strength portions 212 of the main reinforcing bars 21 adjacent to each other in each of the above-mentioned embodiment, welding may also be used to join the normal strength portions 212 in the present invention. Furthermore, although the main reinforcing bar 21 is configured by providing the high strength portion 211 disposed in the central section, the normal strength portions 212 disposed at both the end sections and the strength transition portions 210 disposed between the single high strength portion 211 and the two normal strength portions 212, a configuration in which the high strength portion 211, the strength transition portion 210 and the normal strength portion 212, one each, are disposed for a single steel member may also be used in the present invention.

The present invention is applicable to reinforced concrete structures for buildings.

What is claimed is:

1. A rebar structure comprising:

a plurality of first longitudinal reinforcing bars forming a first frame member; and a plurality of second longitudinal reinforcing bars forming a second frame member, the second longitudinal reinforcing bars intersecting the first longitudinal reinforcing bars in a joint section in which the first frame member and the second frame member are joined to each other, wherein each of the first longitudinal reinforcing bars comprises a first bar portion having a yield point or a 0.2% proof stress defined by JIS G 3112, a second bar portion having a strength higher than a strength of the first bar portion, and a strength transition portion provided between the first bar portion and the second bar portion and having a strength higher than the strength of the first bar portion but lower than the strength of the second bar portion, the first bar portion, the second bar portion and the strength transition portion are formed as a single bar structure, wherein the second bar portion of each of the first longitudinal reinforcing bars is arranged in the joint section, wherein a boundary between the first bar portion and the strength transition portion of each of the first longitudinal reinforcing bars is configured as a design point, the designed point being designed such that, when an external force is applied, the first longitudinal reinforcing bar yields at the designed point before the first longitudinal reinforcing bar yields at a root of the first frame member at the joint section, wherein a boundary between the second bar portion and the strength transition portion of each of the first longitudinal reinforcing bars is located inside the joint section, and the root of the first frame member is located at the strength transition portion, and wherein the strength of the strength transition portion of each of the first longitudinal reinforcing bars at the root of the first frame member is designed to be equal to or higher than a strength back-calculated from a moment distribution.

2. The rebar structure according to claim 1, wherein the first frame member is a beam and the second frame member is a column.

3. A rebar structure comprising:

a plurality of first longitudinal reinforcing bars forming a first frame member; and a plurality of second longitudinal reinforcing bars intersecting the first longitudinal reinforcing bars and forming a plurality of second frame members, wherein each of the first longitudinal reinforcing bars comprises a first bar portion having a yield point or a 0.2% proof stress defined by JIS G 3112, a second bar portion having a strength higher than a strength of the first bar portion, and a strength transition portion provided between the first bar portion and the second bar portion and having a strength higher than the strength of the first bar portion but lower than the strength of the second bar portion, the first bar portion, the second bar portion and the strength transition portion are formed as a single bar structure, wherein the second bar portion of each of the first longitudinal reinforcing bars is arranged in a joint section in which the first frame member and one of the second frame members are joined to each other, wherein a boundary between the first bar portion and the strength transition portion of each of the first longitudinal reinforcing bars is configured as a design point, the designed point being designed such that, when an external force is applied, the first longitudinal reinforcing bar yields at the designed point before the first longitudinal reinforcing bar yields at a root of the first frame member at the joint section, wherein a boundary between the second bar portion and the strength transition portion of each of the first longitudinal reinforcing bars is located at or outwardly away from the root of the first frame member, wherein a distance between opposed surfaces of adjacent ones of the second frame members is 2 meters or longer but not longer than 8 meters, and a length of the strength transition portion of each of the first longitudinal reinforcing bars is equal to or shorter than 1.5 meters.

4. The rebar structure according to claim 3, wherein the first frame member is a beam and the second frame members are columns.

* * * * *